US005592072A

United States Patent [19]

Brown

[11] Patent Number: 5,592,072

[45] Date of Patent: Jan. 7, 1997

[54] HIGH PERFORMANCE DUAL SECTION VOLTAGE REGULATOR

[75] Inventor: Alan E. Brown, Georgetown, Tex.

[73] Assignee: Dell USA, L.P., Austin, Tex.

[21] Appl. No.: 377,575

[22] Filed: Jan. 24, 1995

[51] Int. Cl.[6] ..... G05F 1/40

[52] U.S. Cl. ..... 323/268; 323/271; 323/277

[58] Field of Search ..... 323/266, 268, 323/271, 273, 282, 275, 277

[56] References Cited

U.S. PATENT DOCUMENTS

| | | | |
|---|---|---|---|
| 4,679,130 | 7/1987 | Moscovici | 363/17 |
| 4,881,023 | 11/1989 | Perusse et al. | 323/266 |
| 4,893,228 | 1/1990 | Orrick et al. | 363/89 |
| 5,216,351 | 6/1993 | Shimoda | 323/224 |
| 5,357,418 | 10/1994 | Clavel | 363/89 |
| 5,414,340 | 5/1995 | Gannon | 323/266 |

*Primary Examiner*—Peter S. Wong
*Assistant Examiner*—Shawn Riley
*Attorney, Agent, or Firm*—Haynes and Boone, L.L.P.

[57] ABSTRACT

The voltage regulator includes two sections, a switching regulator section (12) for regulating a voltage from an input (10) to an intermediate node (14). This voltage on the intermediate node (14) is then regulated with a linear regulator down to a regulated output voltage on an output node (18). The linear regulator includes a pass transistor (16) that is controlled by a linear regulator control (50). Linear regulator control (50) is operable to sense the voltage across the transistor (16) and perform multiple functions. First, it controls the pass element transistor (16) to regulate the voltage from the node (14) to the node (18) in a linear manner. Second, it controls the switching regulator section (12) to provide a regulated voltage on the node (14). Third, it controls the level of the voltage on the intermediate node (14) such that it is at a predetermined voltage level above the voltage on the output node (18), such that the power dissipation through the pass element transistor (16) is minimized.

12 Claims, 2 Drawing Sheets

HIGH PERFORMANCE DUAL SECTION VOLTAGE REGULATOR

TECHNICAL FIELD OF THE INVENTION

The present invention pertains in general to voltage regulators, and more particularly, to a voltage regulator utilizing a combination of switching regulation and linear regulation.

BACKGROUND OF THE INVENTION

When microprocessors were introduced into the consumer market, the volume of microprocessors increased significantly. However, the desire to produce personal computing systems for the average consumer drove the cost and the associated profit margins down dramatically. In order to design within these cost constraints, all aspects of the personal computing system needed to be designed from a cost standpoint. One aspect of the personal computer that has been difficult to design from a cost minimization standpoint is the power supply. Although the performance of personal computers has increased and the cost of the microprocessors has gone down, the power supply requirements for these microprocessors has increased dramatically.

In early microprocessor designs, the microprocessor obtains power directly from the system's power supply assembly, with the system's power supply assembly providing a separate tap that could drive the microprocessor. With respect to these early microprocessor designs, load transitions were mild enough to allow operation with low cost point-load bulk storage capacitors, as well as by-pass capacitors to control ringing between the supply and ground. It was not uncommon for these early microprocessor designs to have a supply voltage tolerance of 10% of the nominal voltage level.

As microprocessors became more powerful, the microprocessor voltage was introduced at 3.3 volts with a 5% allowable tolerance. This required most manufacturers to provide DC-to-DC regulation on the board itself. Both linear and switching regulation solutions were utilized successfully. With single processor designs, the linear regulation method was less costly, but did result in a higher thermal dissipation due to various loads. These were still controllable through the design of the supply itself. When multiple processors were utilized on the single processor board, switching regulation was typically utilized as the power supply of choice due to the thermal considerations, i.e., switching regulators are much more energy efficient. However, from a design standpoint, a linear regulator has an inherently better dynamic response than a switching regulator, whereas the switching regulator has superior power conversion efficiencies which equate to thermal management within a power supply design. When utilizing a switching regulator design to accommodate the thermal necessities of the design, power supply designers typically utilize capacitors having a very low Equivalent Series Resistance (ESR). However, these capacitors are fairly expensive and are not consistent with the cost objectives for the power supply design in consumer personal computing systems.

One system for solving the above problems is disclosed in U.S. Pat. No. 4,893,228. This system utilizes a switching pre-regulator and a linear regulator. The pre-regulator is utilized to lower the primary voltage prior to the linear regulation operation such that the voltage across the pass element in the linear regulator is not the difference between the primary voltage and the regulated voltage output.

SUMMARY OF THE INVENTION

The present invention disclosed and claimed herein comprises a regulator for regulating an input voltage and outputting a regulated voltage. The regulator includes a switching regulator and a linear regulator. The switching regulator is disposed between an input node for receiving the input voltage and an intermediate node. The switching regulator is operable to regulate the input voltage down to an intermediate voltage on the intermediate node. The linear regulator is connected between the intermediate node and an output node for regulating the intermediate voltage down to a predetermined output voltage level which comprises the regulated output voltage. A regulator control controls at least the switching regulator to vary the intermediate voltage to a level that is a predetermined voltage above the output voltage for varying current ranges through the linear regulator to minimize power dissipation in the linear regulator.

In another aspect of the present invention, the regulator control controls the switching regulator as a function of the voltage across the linear regulator between the intermediate node and the output node such that the voltage across the linear regulator is maintained substantially constant.

In a further aspect of the present invention, the regulator control includes a voltage sensor for sensing the intermediate voltage and a switching regulator control for utilizing the sensed intermediate voltage to control the switching regulator operation. This provides a regulated intermediate voltage at an absolute intermediate voltage level. The absolute value of the intermediate voltage is proportional to a reference voltage. A differential voltage level is then operable to sense the differential voltage across the linear regulator and then an offset control is operable to modify the absolute value of the output voltage when the differential voltage deviates from a predetermined level, such that the differential voltage across the linear regulator is maintained substantially constant. The offset control includes an error amplifier for generating an error signal when the differential voltage exceeds a predetermined error level. This error is utilized via a reference voltage modification circuit to vary the reference voltage in response to generating the error signal to cause the switching regulator control to vary the intermediate voltage and maintain a constant voltage across the linear regulator.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
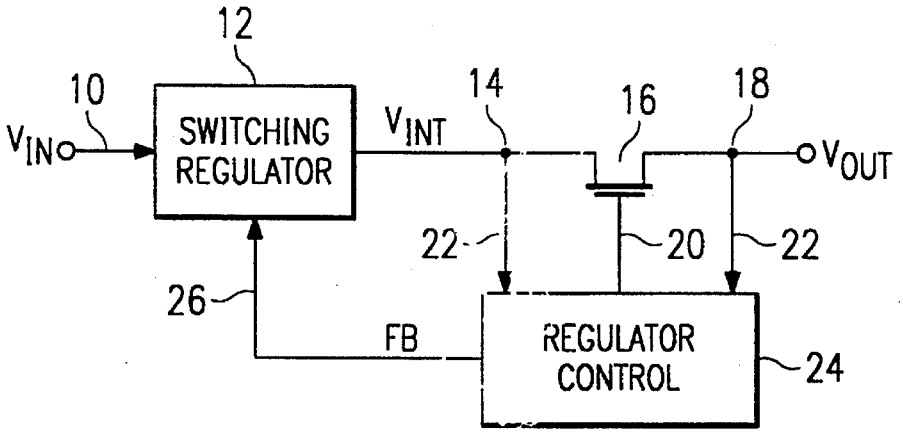
FIG. 1 illustrates a general block diagram of the voltage regulation technique of the present invention.

Referring now to FIG. 1, there is illustrated an overall block diagram of the voltage regulation technique of the present invention. A voltage $V_{IN}$ is received on input terminal 10 and then input to a switching regulator 12. The voltage $V_{IN}$, in the preferred embodiment, is at a level of +5.0 volts and is typically a voltage that is received from a power supply in a personal computing system. This voltage is typically regulated, but the regulation provided thereby is insufficient for being supplied to a microprocessor. The output of a switching regulator 12 provides an intermediate voltage on a node 14. This voltage is at a first regulated voltage, which regulation is determined by the switching regulator 12. The node 14 is connected to one side of the source/drain path of an N-channel transistor 16 that functions as a pass element. The other side of the source/drain path of the transistor 16 is connected to an output node 18, which comprises the output voltage $V_{OUT}$. The voltage $V_{OUT}$ is a voltage of, for example, 3.3 volts in the preferred embodiment. This is a voltage that has a voltage tolerance of approximately 5%, which is required for present day microprocessors.

The transistor 16 is driven by an output drive signal on a line 20 that is connected to the gate of the transistor 16. The voltage on node 14 and the voltage on node 18 are sensed via sense lines 22. The sense lines 22 are input to a regulator control circuit 24, which regulator control circuit 24 is also operable to generate the control signal on line 20. The regulator control signal 24 is operable to output a feedback signal on a line 26 for input to the switching regulator 12 to control the regulation operation thereof.

In operation, the regulator control circuit 24 senses the voltage at node 14 for the purpose of controlling the switching regulator 12 to provide the regulator voltage at the voltage determined to be needed at node 14. Additionally, the voltage across the source/drain of transistor 16 is sensed to maintain this voltage at a predetermined maximum of approximately 0.2 volts. The voltage on node 18 relative to the voltage on node 14 is then regulated by controlling the drive to transistor 16 in accordance with the linear regulation technique. Therefore, it can be seen that regulation of the voltage on node 18, via the transistor 16, is done in such a manner that power dissipation in transistor 16 is minimized. This significantly reduces the thermal considerations required for a linear regulation circuit. By minimizing the voltage differential between nodes 14 and 18, power dissipation can be kept at a minimum while still maintaining the dynamic response of the linear regulation technique. The bulk of the thermal considerations are handled by the switching regulator 12 which has vastly superior power conversion efficiencies.

Figure 2:
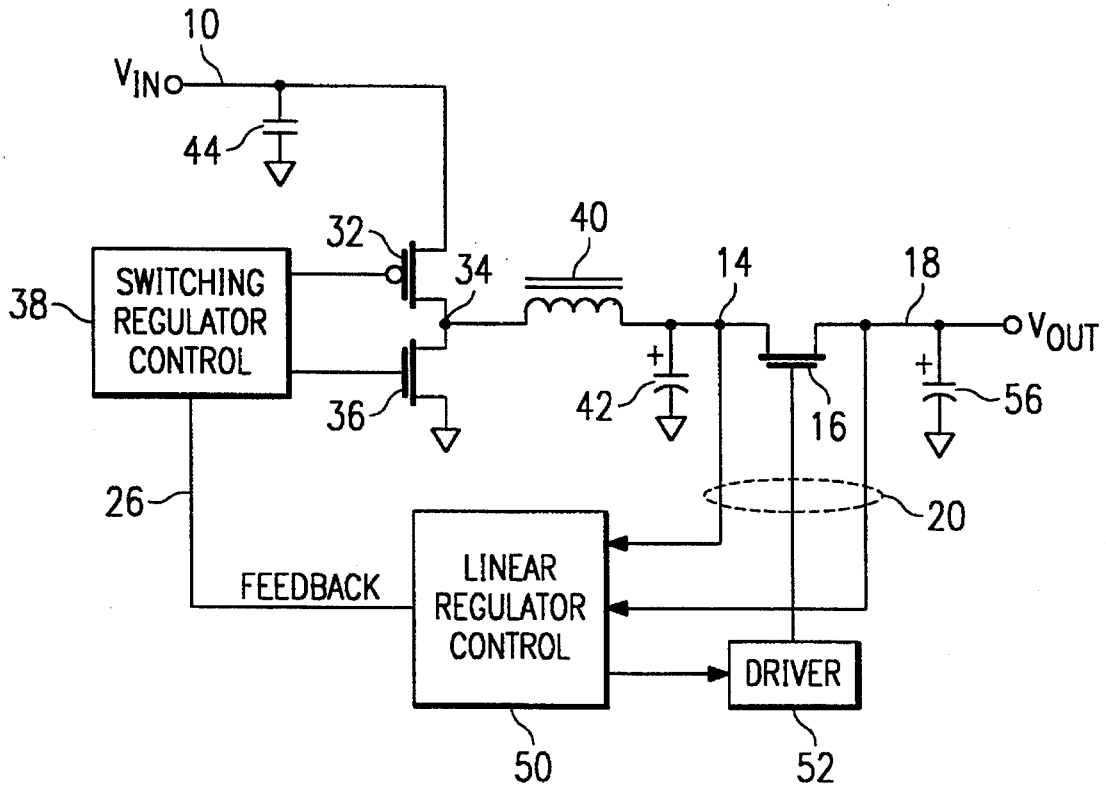
FIG. 2 illustrates a more detailed block diagram of the voltage regulation technique of the present invention.

Referring now to FIG. 2, there is illustrated a more detailed block diagram of the voltage regulation technique of the present invention. Switching regulator 12 is realized with two switching transistors, a P-channel transistor 32, having the source/drain path thereof connected between the input voltage terminal 10 and a node 34, and an N-channel transistor 36 having the source/drain path thereof connected between the node 34 and ground. The gates of transistors 32 and 36 are controlled by a switching regulator control circuit 38, this essentially being a pulse width modulation (PWM) circuit. The PWM control circuit 38 is operable to vary the time the transistors 32 and 36 conduct such that current is delivered to node 34 from the supply 10 for a predetermined amount of time and then the current is removed from node 34 by a transistor 36 for a predetermined amount of time. The relative times that each of the transistors 32 and 36 conduct is controlled by the PWM control circuit 38 in a conventional manner in accordance with a control signal received on the feedback line 26. The node 34 is connected to one side of an inductor 40, the other side thereof connected to node 14. A switching capacitor 42 has the positive plate thereof connected to the node 14 and the negative plate thereof connected to ground. Similarly, the input voltage terminal 10 has a capacitor 44 connected between terminal 10 and ground.

The regulator control 24 is comprised of a linear regulator control circuit 50, which is operable to output the signal to a driver 52, which driver 52 drives the gate of transistor 16 via the line 20. A capacitor 56 is connected between node 18 and ground, with the positive plate thereof connected to node 18 and the negative plate thereof connected to ground.

Figure 3:
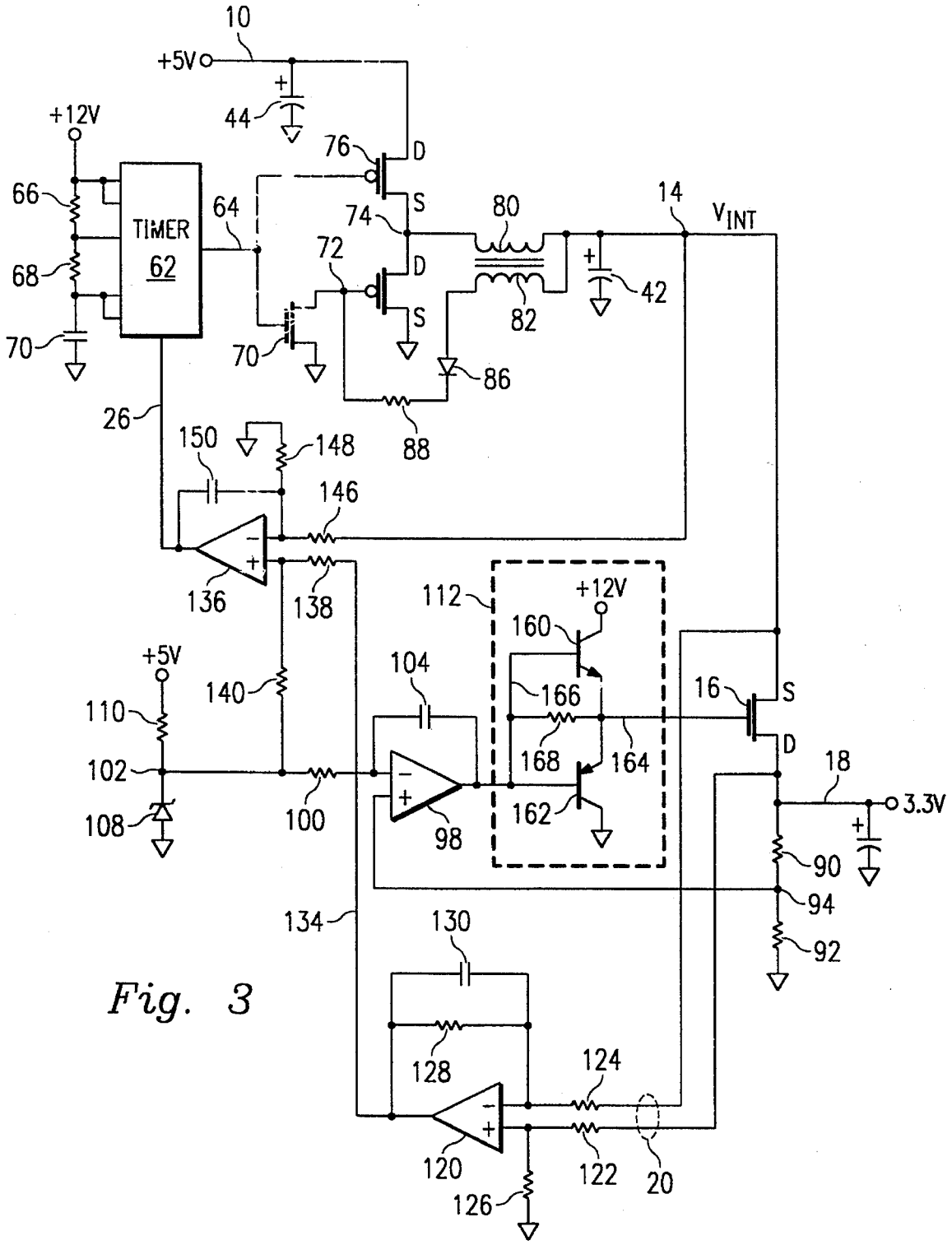
FIG. 3 illustrates a detailed logic diagram of the voltage regulation technique of the present invention illustrating both the linear regulation and switching regulation operation.

Referring now to FIG. 3, there is illustrated a detailed logic diagram of the regulation technique of the present invention. The switching regulator control circuit 38 is realized with a conventional 555 timer circuit 62 which is a conventional integrated circuit timer. This is provided by most integrated circuit semiconductor companies. The output of the timer 62 is provided on a line 64 and is comprised of a series of pulses. The base timing control elements is provided by two resistors 66 and 68 and a capacitor 70, configured in accordance with the general application note associated with the timer 62, this being a conventional configuration. The timer 62 provides for a difference in the time that the output is at a logic 1 and the time it is at a logic 0. This is controlled by the feedback line 26 that is input to the timer 62. Therefore, the timer 62 is configured as a pulse width modulator.

The output 64 of the timer 62 is input to the gate of an N-channel transistor 70, one side of the source/drain path thereof connected to ground and the other side thereof connected to a node 72. Node 72 is connected to the gate of an N-channel transistor 73, the source thereof connected to ground and the drain thereof connected to an output node 74, the output node 74 similar to node 34 of FIG. 2. The output of timer 62 on line 64 is also connected to the gate of an N-channel transistor 76, the source thereof connected to node 74 and the drain thereof connected to the power supply line 10. As noted in FIG. 3, this is set at a voltage of +5.0 volts.

Node 74 is connected to one side of a switching inductor 80, the other side thereof connected to the intermediate voltage node 14. Additionally, there is a sense winding 82 that is disposed about the core along with the switching inductor 80 that has one side thereof connected to the node 14 and the other side thereof connected to the anode of a diode 86, the cathode thereof connected to one side of a resistor 88. The other side of the resistor 88 is connected to the node 72. The resistor 88 has a value of 47 Ohms.

The transistor 16, as described above, provides the pass element for the linear voltage regulation aspect of the present invention. The transistor 16 is oriented such that the source thereof is connected to the node 14 and the drain thereof is connected to the output node 18. Additionally, a voltage sense circuit is provided by a resistive divider formed of two resistors 90 and 92, connected between node 18 and ground with a tap 94 provided therebetween. The tap 94 provides a divided down voltage. The resistor 90 has a resistance of 1.5 K ohms and resistor 92 has a value of 4.7 K ohms. An operational amplifier (Op Amp) 98 is provided having the positive input thereof connected to the node 94 to receive the sensed voltage from the output 18 alter it is divided down, and the negative input of Op Amp 98 is connected through a resistor 100 to a reference voltage node 102. A feedback capacitor 104 is connected between the negative input and output of Op Amp 98. The reference voltage on the reference voltage node 102 is provided by a shum regulator diode 108 having the anode thereof connected to ground and the cathode thereof connected to the node 102. A resistor 110 is connected between the +5.0 voltage supply and node 102 and has a value of 470 ohms. The shum regulator is of the type LT1009 and the reference voltage node 102 has a reference voltage of 2.5 volts. The output of the Op Amp 98 is connected to an inverting driver circuit 112 which is operable to drive the gate of transistor 16. Inverting driver circuit 112 is selected such that it provides the necessary gate current to transistor 16 and has a relatively fast response time, such that the response time of the transistor 16 is not dependent upon the response time of the Op Amp 98. In operation of the linear operating circuit, the Op Amp 98 will control the gate of transistor 16 to maintain the voltage at node 94 at substantially the reference voltage on node 102 such that whenever the voltage begins to increase, the gate voltage will be decreased, thus increasing the transconductance through the source/drain path of transistor 16. When the voltage on node 94 falls, the gate voltage will be increased to reduce the transconductance through transistor 16. As will be described hereinbelow, this operation has a loop response that is high speed from a relative standpoint.

The two sense lines 20 connected one to the source of transistor 16 and one to the drain of transistor 16 are input to the positive and negative inputs of an Op Amp 120 through respective resistors 122 and 124, with the source of transistor 16 connected through resistor 124 to the negative input of the Op Amp 120 and the drain of transistor 16 connected through the resistor 122 to the positive input. A resistor 126 is connected between the positive input of Op Amp 120 and ground. A feedback resistor 128 is connected between the negative input of an Op Amp 120, and a capacitor 130 is connected between the negative input and the output of Op Amp 120. The output of Op Amp 120 is connected to a node 134. Node 134 is connected through a resistor 138 to the positive input of an Op Amp 136 with the positive input of Op Amp 136 also connected through a resistor 140 to the reference voltage node 102. The intermediate voltage node 14 is connected through a resistor 146 to the negative input of Op Amp 136 with the negative input of Op Amp 136 connected to ground through a resistor 148. A feedback capacitor 150 is connected between the negative input and the output of Op Amp 136, the output of Op Amp 136 connected to the feedback line 26 for input to the timer 62 to provide control of the pulse width output thereby.

In operation, the resistors 122 and 126 are sized with resistor 122 being a value of 1 K ohm and the resistor 126 being a value of 4.833 K ohms. Resistor 124 and resistor 128 are both 1 K ohm to give a feedback ratio of 1. This essentially determines the gain of the system. The resistor 138 is sized relative to resistor 140 by a factor of 10 with resistor 138 being a 10 K ohm resistor and resistor 140 being a 1 K ohm resistor. Resistor 148 is sized to be a 1 K ohm resistor with resistor 146 being a 390 ohm resistor.

Whenever the voltage across the source/drain of transistor 16 increases, this will cause the output voltage on Op Amp 120 to fall, as Op Amp 120 is configured as an inverting amplifier. Since Op Amp 136 has the positive input thereof referenced to the reference voltage of 2.5 volts, this will essentially set the output of Op Amp 136 at a nominal 2.5 volt level. This is modified by the output of Op Amp 128. The primary regulation is provided by the sense voltage on the intermediate voltage node 14, which is the voltage at which the switching regulator regulates. The regulation operation is determined by the virtual voltage that is disposed on the positive input of the Op Amp 136. This virtual voltage is a function of the reference voltage on node 102 and also the voltage on the output of Op Amp 120. Therefore, the switching regulator operation is modified by the voltage across the source/drain of transistor 16. The parameters are designed such that the voltage drop across the source/drain of transistor 16 will remain at 0.2 volts with a 3.3 volt output on node 18. Therefore, node 14 is designed to be regulated at 3.5 volts in a steady state position. However, whenever the load changes, it is necessary to ensure that the loop response of the regulation circuit can accommodate the load changes without large transients. In a typical application with microprocessors, they can switch over large current ranges during the operation thereof. For example, the current can switch between a level of 10 amps to and a level of 40 amps in a multiprocessor design. Whenever this load change occurs, it is necessary to rely upon the linear regulation circuit to provide the adequate dynamic range. However, it is important to note that the voltage drop across the transistor 16 is minimized. For example, when a current increase occurs, this will result in transconductance through transistor 16 being reduced. However, when the source/drain voltage decreases, the switching regulator will then increase the voltage on node 14 to attempt to raise the voltage and the source of transistor 16. In operation, the response time for the loops of each of the Op Amps 98, 120 and 136 are set such that the loop response time associated with the Op Amp 98 is the fastest, the loop response time associated with the Op Amp 120 is in a mid-range and the loop response associated with the Op Amp 136 is the slowest. In order to assure that the linear regulation portion operates with the fastest loop response time, the inverting driver circuit 112 is selected such that it is a high current, relatively fast driver. The driver circuit 112 is comprised of an NPN transistor 160 and a PNP transistor 162 connected in complimentary configuration. The transistor 160 has the collector thereof connected to a node 164 and the base thereof connected to a node 166. Node 164 is the output and is connected to the gate of the transistor 16, and node 166 is the input and is connected to the output of amplifier 98. The transistor 162 has the emitter thereof connected to node 164, the base thereof connected to node 166 and the collector thereof connected to ground. A resistor 168 is connected between the nodes 164 and 166.

In summary, there has been provided a voltage regulation circuit for providing a high current regulator that operates over different load demands that combines a linear regulator with a switching regulator. The regulation is controlled such that the output of the switching regulator is a function of the voltage across the source/drain of a gate transistor utilized in the linear regulator portion. Therefore, the voltage input to the linear regulator is a function of the voltage drop across the linear regulator.

Although the preferred embodiment has been described in detail, it should be understood that various changes, substitutions and alterations can be made therein without departing from the spirit and scope of the invention as defined by the appended claims.

What is claimed is:

1. A regulator for receiving an input voltage and outputting a regulated output voltage, comprising:

a switching regulator having a first input and a first output for receiving on the first input the input voltage and providing on the first output a regulated intermediate voltage in accordance with a switching regulator operation, said first output connected to an intermediate node;

a linear regulator having a second input and a second output with a pass element connected therebetween for receiving on said second input said regulated intermediate voltage associated with said intermediate node and for providing to an output node on said second output the regulated output voltage at a predetermined output voltage level by varying the impedance of said pass element in accordance with a linear voltage regulation operation; and a regulator control for regulating at least said switching regulator to vary the regulated intermediate voltage to a level that is a predetermined intermediate voltage above said predetermined output voltage level to maintain a predetermined differential voltage across said pass element to minimize power dissipation in said pass element, said regulator control comprising:

an intermediate voltage sensor for sensing said regulated intermediate voltage;

a switching regulator control for utilizing said sensed regulated intermediate voltage to control said switching regulator operation to regulate said regulated intermediate voltage to said predetermined intermediate voltage level;

a differential voltage sensor comprising an operational amplifier (op amp) having a first op amp input electrically connected to said intermediate node, a second op amp input electrically connected to said output node, and an op amp output, wherein said op amp is configured for sensing via said first and second op amp inputs the differential voltage across said pass element between said intermediate node and said output node and for generating onto said op amp output an op amp signal indicative of the differential voltage sensed between said intermediate node and said output node; and an offset control for modifying said predetermined intermediate voltage when said sensed differential voltage indicated by said op amp signal deviates from said predetermined differential voltage such that said sensed differential voltage is maintained substantially constant and the operation of said switching regulator control is dependent upon said sensed differential voltage.

2. The regulator of claim 1, wherein said pass element has a transconductance associated therewith and said linear regulator comprises:

a voltage sensor for sensing the voltage level of the regulated output voltage; and a linear regulator controller for controlling the transconductance of said pass element to vary the conductance therethrough to maintain the voltage across said pass element at said predetermined differential voltage thereacross.

3. The regulator of claim 1, wherein:

said switching regulator control regulates said regulated intermediate voltage to a level proportionate to a reference voltage; and said offset control comprises:

an error amplifier for generating an error signal when said sensed differential voltage exceeds a predetermined error value, and a reference voltage modification circuit for varying said reference voltage in response to generation of said error signal to control said switching regulator control to vary said switching regulator operation and, subsequently, said regulated intermediate voltage level to maintain said constant sensed differential voltage across said linear regulator from said intermediate node to said output node.

4. The regulator of claim 3, wherein a decrease in said sensed differential voltage causes said switching regulator to increase said regulated intermediate voltage and an increase in said sensed differential voltage causes said switching regulator to decrease said regulated intermediate voltage.

5. The regulator of claim 3, wherein said linear regulator has a response that is faster than the response of said error amplifier and said switching regulator.

6. The regulator of claim 5, wherein said switching regulator has a response that is slower than the response of said error amplifier.

7. A method for providing a regulated output voltage from an input voltage, comprising the steps of:

providing a switching regulator;

inputting the input voltage to the switching regulator to provide a regulated intermediate voltage on an output thereof;

connecting the output of the switching regulator to an intermediate node to provide the regulated intermediate voltage thereon;

providing a linear regulator with a pass element having a series impedance associated therewith and connecting the pass element between the intermediate node and an output node and controlling the pass element to regulate the voltage on the output node to provide the regulated output voltage on the output node at a predetermined output voltage level; and controlling the switching regulator to vary the regulated intermediate voltage to a level that is a predetermined intermediate voltage above the regulated output voltage to maintain a predetermined differential voltage across the pass element to minimize power dissipation in the pass element, the controlling operation being dependent upon the actual differential voltage across the pass element, wherein the controlling operation comprises:

sensing the regulated intermediate voltage on the intermediate node;

controlling the switching regulator operation to regulate the regulated intermediate voltage to provide an absolute value for the regulated intermediate voltage;

providing an operational amplifier (op amp) having a first op amp input electrically connected to said intermediate node, a second op amp input electrically connected to said output node, and an op amp output;

sensing via said first and second op amp inputs the differential voltage across said pass element between said intermediate node and said output node;

generating onto said op amp output an op amp signal indicative of the differential voltage sensed between said intermediate node and said output node; and modifying the absolute value of the regulated intermediate voltage when the sensed differential voltage deviates from the predetermined differential voltage such that the sensed differential voltage is maintained substantially constant through control of the switching regulator.

8. The method of claim 7, wherein the pass element has a transconductance associated therewith and the step of providing the linear regulator comprises:

sensing the actual differential voltage across the transconductance of the pass element; and controlling the transconductance of the pass element to vary the conductance therethrough in response to changes in the sensed differential voltage to maintain the regulated output voltage at the predetermined output voltage level.

9. The method of claim 7, wherein:

the step of controlling the switching regulator comprises controlling the switching regulator to regulate the regulated intermediate voltage to a level proportionate to a reference voltage; and the step of modifying the absolute value of the regulated intermediate voltage comprises the steps of:

generating an error signal when the sensed differential voltage exceeds a predetermined error value, and modifying the reference voltage in response to generation of the error signal to cause the switching regulator to vary the regulated intermediate voltage to maintain the constant sensed differential voltage across the linear regulator.

10. The method of claim 9, wherein a decrease in the sensed differential voltage causes the switching regulator to increase the regulated intermediate voltage on the intermediate node, and an increase in the sensed differential voltage causes the switching regulator to decrease the regulated intermediate voltage on the intermediate note.

11. The method of claim 9, wherein the linear regulator has a response that is faster that the step of generating the error signal and modifying the reference voltage and controlling the switching regulator to vary the regulated intermediate voltage level.

12. The method of claim 11, wherein the switching regulator has a response that is slower than the operation of generating the error signal and varying the reference voltage to cause the switching regulator to modify the regulated intermediate voltage.

* * * * *